US010564585B2

(12) United States Patent
Tashiro

(10) Patent No.: US 10,564,585 B2
(45) Date of Patent: Feb. 18, 2020

(54) SHEET FEEDING DEVICE AND IMAGE FORMING APPARATUS INCLUDING THE SAME

(71) Applicant: KYOCERA Document Solutions Inc., Osaka-shi (JP)

(72) Inventor: Yoshiaki Tashiro, Osaka (JP)

(73) Assignee: KYOCERA Documents Solutions Inc. (JP)

( * ) Notice: Subject to any disclaimer, the term of this patent is extended or adjusted under 35 U.S.C. 154(b) by 0 days.

(21) Appl. No.: 16/011,743

(22) Filed: Jun. 19, 2018

(65) Prior Publication Data

US 2018/0373190 A1 Dec. 27, 2018

(30) Foreign Application Priority Data

Jun. 23, 2017 (JP) ..... 2017-123159

(51) Int. Cl.

| | |
|---|---|
| ***B65H 5/06*** | (2006.01) |
| ***G03G 15/00*** | (2006.01) |
| ***G03G 15/16*** | (2006.01) |
| ***B65H 7/02*** | (2006.01) |

(Continued)

(52) U.S. Cl.

CPC ..... *G03G 15/6511* (2013.01); *B65H 1/04* (2013.01); *B65H 5/06* (2013.01); *B65H 7/02* (2013.01); *G03G 15/1665* (2013.01); *G03G 15/602* (2013.01); *G03G 15/607* (2013.01); *G03G 21/1633* (2013.01); *B65H 2403/411* (2013.01); *B65H 2405/1142* (2013.01); *B65H 2405/1144* (2013.01); *B65H 2405/324* (2013.01); *B65H 2407/21* (2013.01); *B65H 2511/12* (2013.01); *B65H 2511/20* (2013.01);

(Continued)

(58) Field of Classification Search

CPC ..... B65H 2405/114; B65H 2405/1142; B65H 2405/11425; B65H 2405/1144; B65H 2511/12; B65H 2407/21; G03G 15/6514; G03G 2215/00392

USPC ..... 271/171

See application file for complete search history.

(56) References Cited

U.S. PATENT DOCUMENTS

| | | | | |
|---|---|---|---|---|
| 7,976,017 | B2 * | 7/2011 | Shiohara | B65H 1/266 271/171 |
| 8,985,571 | B2 * | 3/2015 | Ueda | B65H 1/04 271/171 |
| 9,944,479 | B2 * | 4/2018 | Nakagawa | B65H 1/266 |

(Continued)

FOREIGN PATENT DOCUMENTS

| | | |
|---|---|---|
| JP | 10-291695 | 11/1998 |

*Primary Examiner* — Jeremy R Severson

(74) *Attorney, Agent, or Firm* — Gerald E. Hespos; Michael J. Porco; Matthew T. Hespos

(57) ABSTRACT

A sheet feeding device includes a sheet stacking base having a base surface for a sheet, a feeding member, and a pair of cursors. The pair of cursors includes first and second cursors that separate from and come close to each other along the sheet width direction, and is movable between first position and second position. The first and second cursors are separated by the maximum distance at the first position and by the minimum distance at the second position. The first cursor includes a movable base part, and a movable sub-cursor. When a narrow sheet is placed on the base surface, the sub-cursor is moved from the reference position toward the second cursor to be brought into contact with a side face of the narrow sheet to thereby position the narrow sheet.

6 Claims, 8 Drawing Sheets

(51) Int. Cl.
*G03G 21/16* (2006.01)
*B65H 1/04* (2006.01)

(52) U.S. Cl.
CPC ..... *B65H 2511/22* (2013.01); *B65H 2513/40* (2013.01); *B65H 2553/21* (2013.01); *B65H 2553/82* (2013.01)

(56) References Cited

U.S. PATENT DOCUMENTS

2012/0025442 A1* 2/2012 Naraoka ..... B42B 4/00
270/58.12
2014/0291925 A1* 10/2014 Zou ..... B65H 1/04
271/240
2015/0097329 A1* 4/2015 Ukai ..... B65H 1/04
271/9.07

* cited by examiner

SHEET FEEDING DEVICE AND IMAGE FORMING APPARATUS INCLUDING THE SAME

INCORPORATION BY REFERENCE

This application is based on Japanese Patent Application No. 2017-123159 filed on Jun. 23, 2017 to the Japan Patent Office, the contents of which are incorporated by reference.

BACKGROUND

The present disclosure relates to a sheet feeding device that feeds a sheet and an image forming apparatus including the sheet feeding device.

An image forming apparatus including a sheet feeding device that feeds a sheet, such as a copying machine and a printer, is known. The sheet feeding device is mounted in a main body of the image forming apparatus. The sheet feeding device includes a sheet stacking base that has a base surface on which a sheet is placed, and a cursor that positions a sheet placed on the base surface.

The sheet feeding device is required to feed sheets of various sizes. Thus, the cursor should be capable of positioning sheets of various sizes. There is a known art related of positioning a sheet by a cursor.

In the prior art, a pair of first cursors (first sheet guides) and a pair of second cursors (second sheet guides) position a sheet placed on a base surface of a sheet stacking base (feeding table). The pair of first cursors is movable on the base surface of the sheet stacking base in conjunction with each other along a sheet width direction to separate from and come close to each other. The pair of second cursors is supported in a manner allowed to pivot upward and downward relative to the base surface. In another embodiment, the pair of second cursors is supported in a manner allowed to pivot upward and downward relative to the first cursors. For example, a sheet of A5 size or larger is positioned by moving the pair of first cursors in the sheet width direction with the pair of second cursors housed in a guide housing. A sheet of a narrow size, such as a name card size, is positioned by the pair of second cursors with the pair of second cursors set upright.

In the known art, the pair of first cursors is movable on the base surface in the sheet width direction. Meanwhile, the pair of second cursors can pivot in upward and downward directions but cannot move in the sheet width direction or moves together with the pair of first cursor.

SUMMARY

A sheet feeding device according to an aspect of the disclosure includes a sheet stacking base, a feeding member, and a pair of cursors. The sheet stacking base has a base surface on which a sheet is placed. The feeding member is provided at a center of the base surface in the sheet width direction, of the base surface, and feeds a sheet placed on the base surface in a feeding direction perpendicular to the sheet width direction. The pair of cursors includes a first cursor and a second cursor for positioning a sheet placed on the base surface. The first cursor and the second cursor separate from and come close to each other on the base surface with the center of the base surface in the sheet width direction used as a first reference position.

The first and second cursors are movable between a first position and a second position. The first and second cursors are separated by the maximum distance at the first position and by the minimum distance at the second position. The first cursor of the pair of cursors includes a base part that is movable on the base surface in the sheet width direction, and a sub-cursor that is movable on the base part toward the second cursor from a second reference position, the sub-cursor being, at the second reference position, a portion for positioning the sheet in the first cursor. In a case where a narrow sheet having a width smaller than the distance between the first cursor with the sub-cursor arranged at the second reference position and second cursors at the second position is placed on the base surface, the sub-cursor is moved from the second reference position toward the second cursor to be brought into contact with a side face of the narrow sheet, to thereby position the narrow sheet.

The image forming apparatus according to another aspect of the disclosure includes a main body, an image forming unit disposed in the main body to form an image on a sheet, and the sheet feeding device that is mounted in the main body to feed a sheet to the image forming unit.

DETAILED DESCRIPTION

A sheet feeding device and an image forming apparatus according to an embodiment of the disclosure will now be described based on the drawings. The directional relationship will be described using XYZ orthogonal coordinate axes in the following description. X-direction represents the right-and-left direction (+X is the rightward direction and −X is the leftward direction). Y-direction represents the front-and-rear direction (+Y is the forward direction and −Y is the rearward direction). Z-direction represents the vertical direction (+Z is the upward direction and −Z is the downward direction). In the following description, the term "sheet" means a sheet material, such as a copying paper, a coated paper, an OHP sheet, a cardboard, a postcard, a tracing paper, a sheet material subjected to image forming processing, and a sheet material subjected to any processing other than image forming processing.

[Overall Configuration of Image Forming Apparatus]

Figure 1:
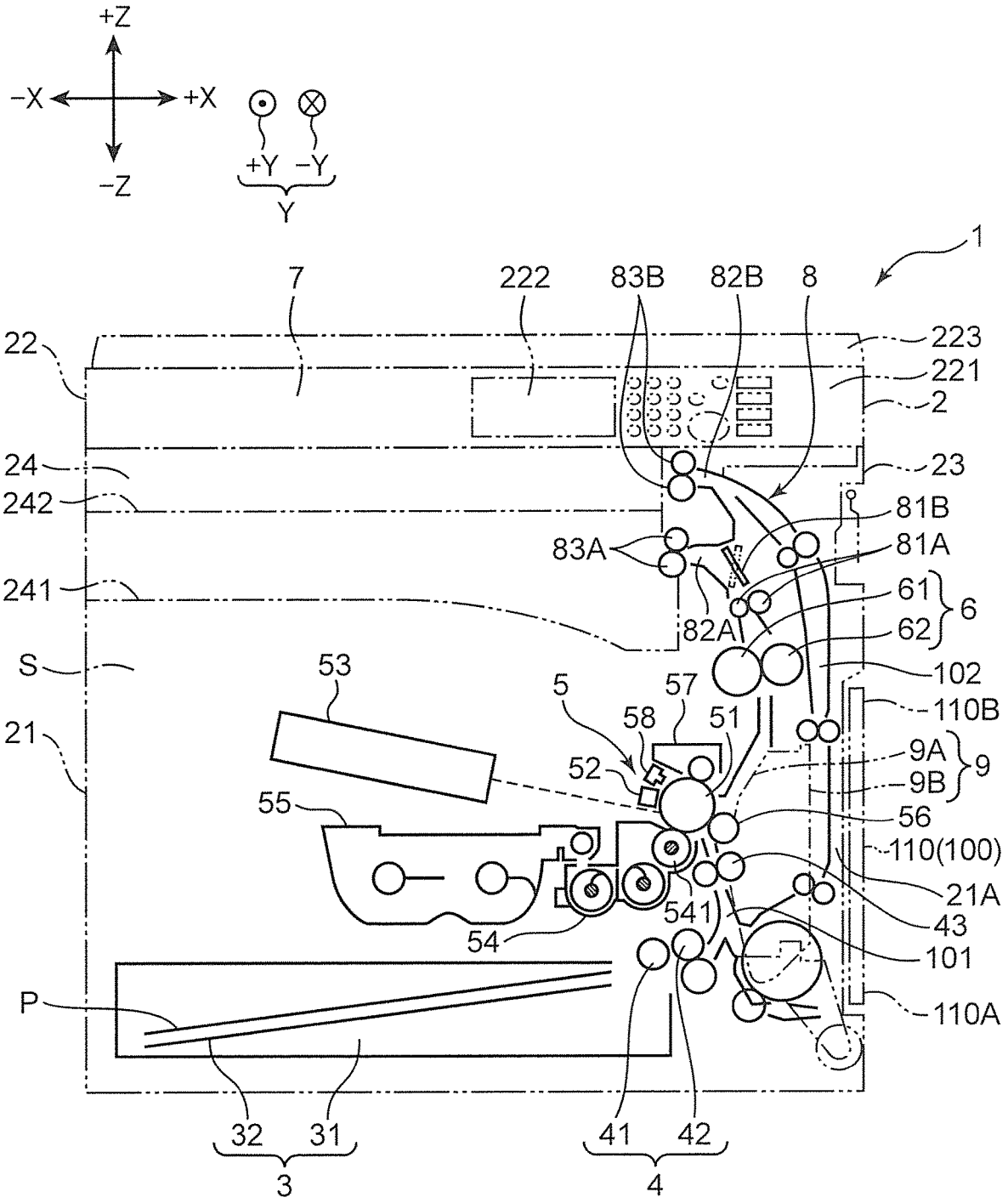
FIG. 1 is a view schematically illustrating an internal configuration of an image forming apparatus including a sheet feeding device according to an embodiment of the disclosure.

FIG. 1 is a view schematically illustrating an internal configuration of an image forming apparatus 1 including a sheet feeding device 100 according to an embodiment of the disclosure. The image forming apparatus 1 is of an electrophotographic apparatus that forms an image on a sheet P. Although a black-and-white copier is exemplarily described as the image forming apparatus 1, the image forming apparatus 1 may be a printer, a fax machine, or a multifunction machine having functions of a printer and a fax machine. The image forming apparatus 1 may be configured to form color images.

The image forming apparatus 1 includes a main body 2, a sheet stocker 3 disposed in the main body 2, a sheet feeder 4, an image forming unit 5, a fixing unit 6, an image reading unit 7, a sheet discharging unit 8, a sheet conveying unit 9, and a sheet feeding device 100.

The main body 2 includes a lower housing 21 having a rectangular external shape, and an upper housing 22 that has a rectangular shape and is provided above the lower housing 21 to oppose the lower housing 21. The lower housing 21 and the upper housing 22 are joined by a joining part 23 that forms a part of the lower housing 21. The joining part 23 rises from the side of the lower housing 21 in +X side (right side). The upper housing 22 is supported by an end (upper end), at +Z side (upper side), of the joining part 23 via a portion of the upper housing 22 at +X side. The sheet P on which image forming processing is performed is discharged by the sheet discharging unit 8 to a discharge space 24 surrounded by the lower housing 21, the upper housing 22, and the joining part 23.

The upper housing 22 is provided with the image reading unit 7. The image reading unit 7 is for reading an image on an original copy and includes an original-copy holding cover 223 provided at +Z side of the upper housing 22. The original-copy holding cover 223 is attached to the upper housing 22 in a manner allowed to pivot upward and downward to hold the original copy. Analogue information of an image of the original copy that is read by the image reading unit 7 is converted into a digital signal and then is output to an exposure device 53, which will be described later, to be processed by image forming processing.

A manipulation unit 221 is provided in a portion of the upper housing 22 at +Y side (front side). The manipulation unit 221 includes, for example, a liquid crystal display (LCD) touch panel 222. Information related to image forming processing can be input through the manipulation unit 221. For example, a user can input the size and the number of sheets P to be printed, and the print density of the sheets P through the LCD touch panel 222.

A side cover 21A that forms a +X side portion of the lower housing 21 is provided with the sheet feeding device 100. The sheet feeding device 100 includes a manual feed tray 110 (sheet stacking base) used for manually feeding a sheet. The manual feed tray 110 is pivotable about the bottom end 110A to allow the upper end 110B to move upward and downward. The manual feed tray 110 can change a position between a closed position where the manual feed tray 110 is set upright to close the manual feeding port and an opened position where the manual feed tray 110 projects toward +X side. The manual feed tray 110 is positioned in the opened position for manually feeding the sheet P. The sheet feeding device 100 sends the sheet P placed on the manual feed tray 110 to a main conveyance path 101. The main conveyance path 101 runs, via a resist roller pair 43, through a transfer nip formed between a photoreceptor drum 51 and a transfer roller 56 in the image forming unit 5. The resist roller pair 43 determines the position of the sheet P in a direction perpendicular to the sheet conveyance direction. The resist roller pair 43 conveys the sheet P to the image forming unit 5 at a proper timing for a toner image to be transferred onto the sheet P in the image forming unit 5. Details on the sheet feeding device 100 will be described later.

The sheet stocker 3, the sheet feeder 4, the image forming unit 5, the fixing unit 6, the sheet discharging unit 8, and the sheet conveying unit 9 are provided in an internal space S of the lower housing 21.

The sheet stocker 3 can be pushed into and out of the lower housing 21, and includes a tray 31 that stores the sheet P, and a lift plate 32 that supports the sheet P in the tray 31. The lift plate 32 is inclined so as to push up the front edge of the sheet P at +Z side.

The sheet feeder 4 is a sheet feeding unit that feeds the sheet P stored in the tray 31 and includes a pickup roller 41 and a feed roller 42. In the sheet feeder 4, the pickup roller 41 and the feed roller 42 send the sheet P stored in the tray 31 to the main conveyance path 101, one by one.

The image forming unit 5 performs image forming processing on the sheet P supplied from the sheet feeding device 100 or the sheet P supplied from the sheet feeder 4. The image forming unit 5 includes a photoreceptor drum 51, a charging unit 52, an exposure device 53, a developing device 54, a toner container 55, a transfer roller 56, a cleaning device 57, and a neutralizing unit 58.

The photoreceptor drum 51 is a cylindrical drum driven to rotate about an axis extending in Y direction. The photoreceptor drum 51 carries, on its circumferential surface, an electrostatic latent image as well as a toner image corresponding to the electrostatic latent image. The charging unit 52 charges the circumferential surface of the photoreceptor drum 51 before the photoreceptor drum 51 carries an electrostatic latent image.

The exposure device 53 emits a laser beam to the circumferential surface of the photoreceptor drum 51 charged by the charging unit 52 and thereby forms an electrostatic latent image. The developing device 54 includes a developing roller 541 that supplies toner (developing agent) to the circumferential surface of the photoreceptor drum 51 on which an electrostatic latent image is formed. The developing roller 541 is driven to rotate about an axis parallel to the photoreceptor drum 51 and can carry the toner. By applying a predetermined developing bias to the developing roller 541, the electrostatic latent image formed on the circumferential surface of the photoreceptor drum 51 is developed with the carried toner. A toner container 55 supplies replenishing toner to the developing device 54.

The sheet P is sent, via the main conveyance path 101 and the resist roller pair 43, to the photoreceptor drum 51 on which the toner image is formed by the developing device 54. The transfer roller 56 transfers the toner image formed on the circumferential surface of the photoreceptor drum 51 onto the sheet P. The transfer roller 56 is rotatable about an axis parallel to the photoreceptor drum 51, and contacts the circumferential surface of the photoreceptor drum 51 to form the transfer nip. The transfer roller 56 is given a transfer bias having a polarity that is opposite to the polarity of the toner. The sheet P on which the toner image is transferred is separated from the photoreceptor drum 51 and is conveyed by the sheet conveying unit 9 to the fixing unit 6.

The sheet conveying unit 9 includes a first side face 9A that opposes the image forming unit 5 and forms the main conveyance path 101, and a second side face 9B that is on the back side of the first side face 9A and opposes the side cover 21A of the main body 21 to form a reverse conveyance path 102. The resist roller pair 43 and the transfer roller 56 constitute a part of the sheet conveying unit 9. In the sheet conveying unit 9, the resist roller pair 43 and the transfer roller 56 are disposed on the first side face 9A. The sheet conveying unit 9 is supported between the main body 21 and the side cover 21A in a swingable manner. By opening the side cover 21A, the main conveyance path 101 and the reverse conveyance path 102 are exposed.

The cleaning device 57 removes untransferred toner that is adhered to the circumferential surface of the photoreceptor drum 51 after the toner image is transferred. The untransferred toner is removed from the photoreceptor drum 51 by the cleaning device 57 and conveyed to a toner collecting box (not shown) to be collected. The neutralizing unit 58 emits a predetermined neutralizing light to the photoreceptor drum 51 of which circumferential surface is cleaned by the cleaning device 57. As a result, residual charge on the circumferential surface of the photoreceptor drum 51 is neutralized.

The sheet conveying unit 9 transfers the sheet P onto which the toner image is transferred, and the fixing unit 6 performs fixing processing on the sheet P to fix the toner image on the sheet P. The fixing unit 6 includes a fixing roller 61 having a heating source therein, and a pressing roller 62 that is pressed against the fixing roller 61 to form the fixing nip between the pressing roller 62 and the fixing roller 61. When the sheet P with the toner image transferred thereon passes through the fixing nip, the toner image is fixed on the sheet P due to heating by the fixing roller 61 and pressing by the pressing roller 62.

After the fixing processing has been performed, the sheet P is conveyed in the downstream along the sheet conveyance direction by the conveyance roller pair 81A of the sheet discharging unit 8 provided above the fixing unit 6. A discharge branching guide 81B is provided in the downstream of the conveyance roller pair 81A. In the downstream, along the sheet conveyance direction, of the conveyance roller pair 81A, the discharge branching guide 81B switches the conveyance direction for the sheet P. The discharge branching guide 81B switches the conveyance direction of the sheet P, and the sheet P is introduced to a first conveyance path 82A or a second conveyance path 82B.

If the sheet P is for one-side printing, the sheet P on which the fixing processing is performed is discharged to the discharge space 24 either by a first discharge roller pair 83A disposed on the first conveyance path 82A or by a second discharge roller pair 83B disposed on the second conveyance path 82B. The sheet P discharged to the discharge space 24 by the first discharge roller pair 83A is stacked on a first sheet stacking section 241 provided on the top face of the lower housing 21. The sheet P discharged to the discharge space 24 by the second discharge roller pair 83B is stacked on a second sheet stacking section 242 provided above the first sheet stacking section 241.

If the sheet P on which the fixing processing is performed is for double-side printing and the printing processing has been completed on one side of the sheet P, the sheet P is held by the second discharge roller pair 83B disposed on the second conveyance path 82B. At this state, the second discharge roller pair 83B is reversed to switch back the sheet P. In this manner, the sheet P is conveyed in the opposite direction through the reverse conveyance path 102 to be supplied to the image forming unit 5 with the front side and the back side turned over, so that the image forming processing is performed on the back side. After printing is done on both sides, the sheet P is discharged to the discharge space 24 through the first conveyance path 82A or the second conveyance path 82B of the sheet discharging unit 8.

[Detailed Configuration on Sheet Feeding Device]

Figure 2:
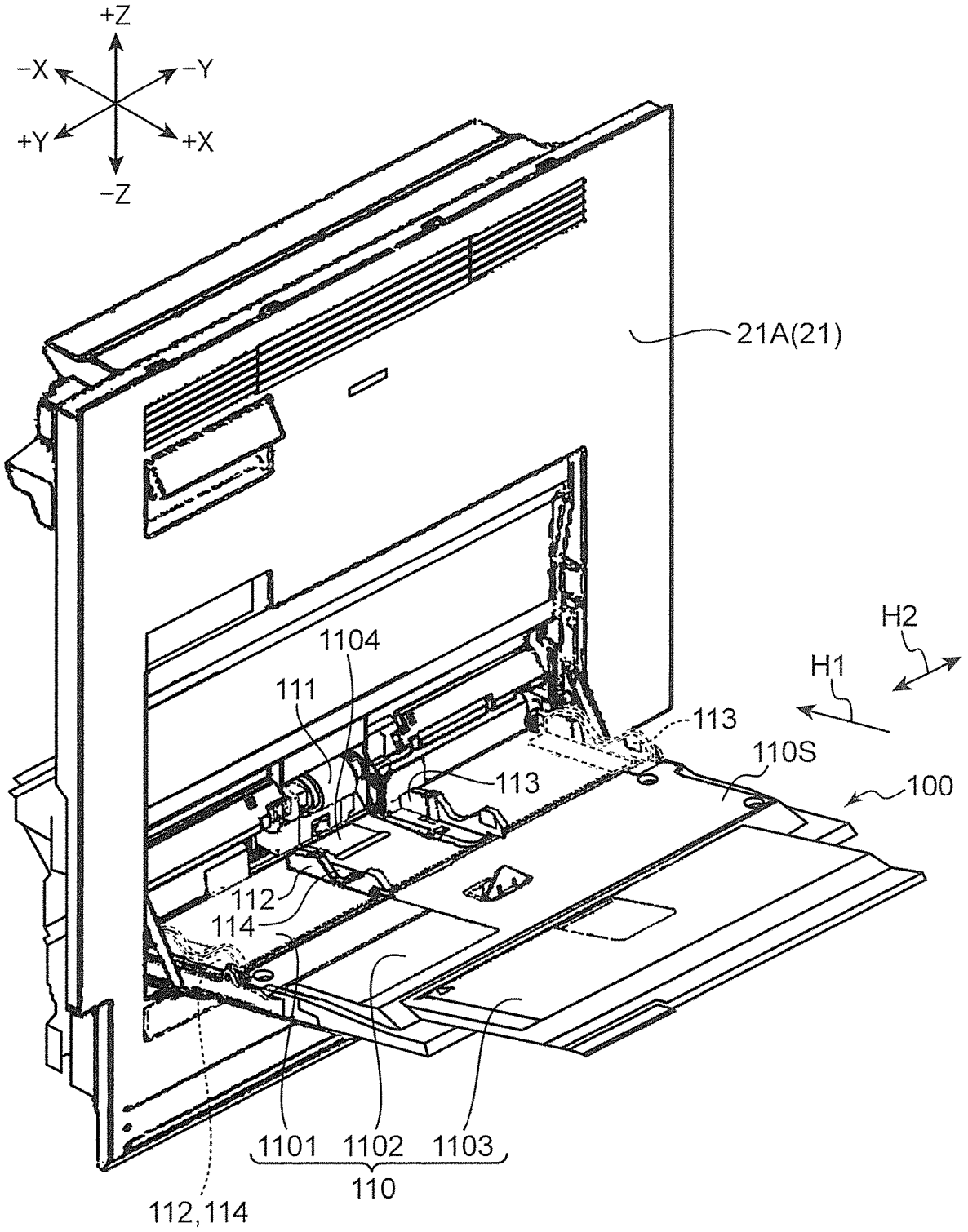
FIG. 2 is a perspective view of the sheet feeding device.
Figure 3:
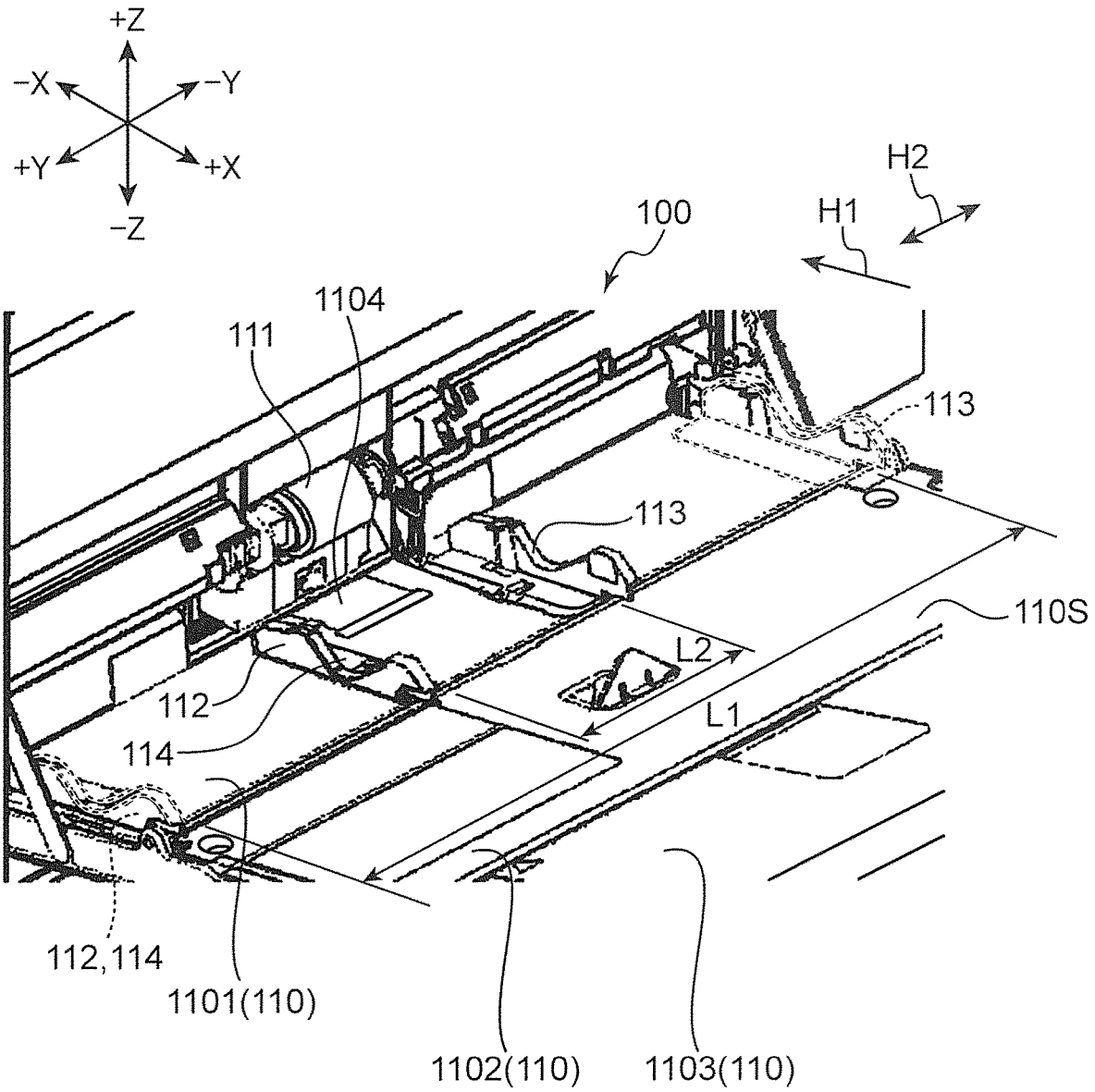
FIG. 3 is a perspective view illustrating, in an enlarged manner, an essential portion of the sheet feeding device.
Figure 4:
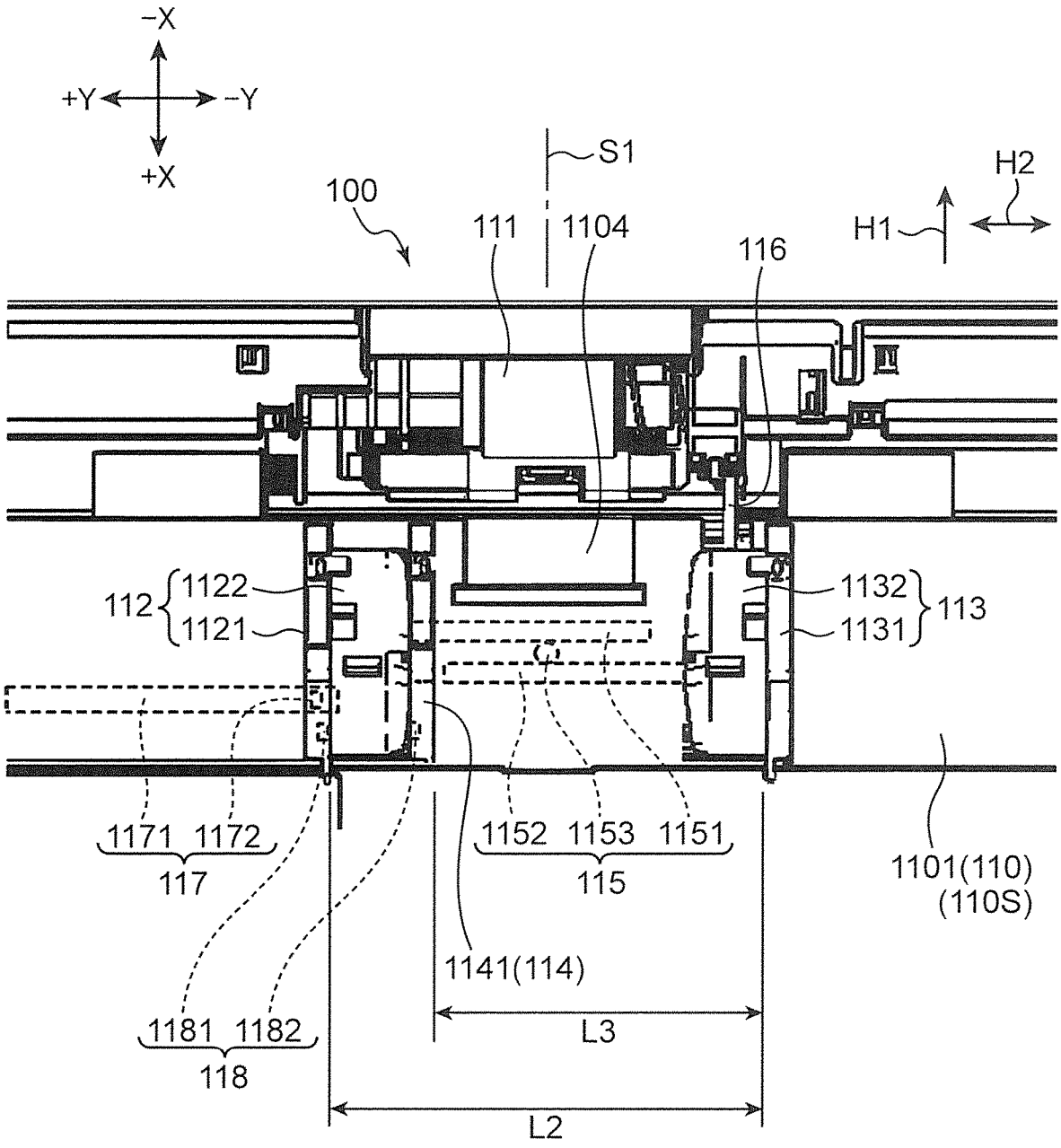
FIG. 4 is a plan view illustrating, in an enlarged manner, an essential portion of the sheet feeding device.

The configuration of the sheet feeding device 100 will now be described in detail with reference to FIGS. 2 to 4. FIG. 2 is a perspective view of the sheet feeding device 100. FIGS. 3 and 4 illustrate, in an enlarged manner, an essential portion of the sheet feeding device 100. FIG. 3 is a perspective view, and FIG. 4 is a plan view.

The sheet feeding device 100 can feed the sheets P of various sizes in a predetermined feeding direction H1. The feeding direction H1 is the direction from +X side to −X side. The sheet feeding device 100 can feed the sheets P of various sizes including a normal width sheet P1 of a normal size that has a width equal to or larger than a predetermined width and a narrow sheet P2 of a special size that has a width smaller than the predetermined width. The normal width sheet P1 includes a sheet P of a standard sheet size such as A4 (210 mm×296.98 mm), B4 (257 mm×364 mm), and A3 (296.98 mm×420 mm) and a sheet P of a standard mail size such as a post card size (100 mm×148.5 mm), and No. 4 letter size (105.01 mm×235.01 mm). For example, the sheet P that has a width smaller than 100 mm is determined as the narrow sheet P2 of a special size.

The sheet feeding device 100 includes, in addition to the manual feed tray 110 that serves as the sheet stacking base described above, a feeding roller 111 (an example of a feeding member) and a pair of cursors 112 and 113.

The manual feed tray 110 includes a lifting plate 1101, a tray body 1102, and an auxiliary tray 1103. Top faces of the lifting plate 1101, the tray body 1102, and the auxiliary tray 1103 constitute a rectangular base surface 110S of the manual feed tray 110 on which the sheet P is placed. The tray body 1102 is a main part of the manual feed tray 110 having a form of an approximately rectangular plate.

The lifting plate 1101 is a plate member disposed in the downstream along the feeding direction H1 of the tray body 1102. The downstream end, along the feeding direction H1, of the lifting plate 1101 can pivot upward and downward relative to the tray body 1102 by a lifting mechanism (not shown). The downstream end, along the feeding direction H1, of the lifting plate 1101 rises, and therefore the sheet P placed on the tray body 1102 including the lifting plate 1101 is brought into contact with the feeding roller 111. On the base surface 110S of the manual feed tray 110, a pad 1104 is provided in the center, along the sheet width direction H2 (perpendicular to the feeding direction H1), of the top face of the lifting plate 1101 and on the distal end, along the feeding direction H1, of the lifting plate 1101. The pad 1104 is disposed to oppose the feeding roller 111. The pad 1104 serves as a stopper that prevents the last sheet in the bottom of the stack of sheets P placed on the base surface 110S from entering the feeding nip of the feeding roller 111 from the top face of the lifting plate 1101. A separation pad (not shown) is provided in the downstream, along the feeding direction H1, of the pad 1104 and below the feeding roller 111 to form the feeding nip with the feeding roller 111. The separation pad prevents double feeding of the sheets P.

The auxiliary tray 1103 is a plate member that can be pulled out in +X side from the tray body 1102. By pulling out the auxiliary tray 1103 from the tray body 1102, a longer sheet P can be placed on the manual feed tray 110.

The feeding roller 111 is driven to rotate by a driving mechanism (not shown), and thereby the sheet P placed on the manual feed tray 110 is fed in the feeding direction H1. The feeding roller 111 is provided in the downstream, along the feeding direction H1, of the manual feed tray 110 and in the center, along the sheet width direction H2, of the base surface 110S.

A pair of cursors 112 and 113 is disposed on the top face (base surface 110S) of the lifting plate 1101 of the manual feed tray 110. A pair of cursors 112 and 113 can move on the base surface 110S, with the sheet width direction center S1

(see FIG. 4) on the base surface 110S used as the reference position (first reference position), to come close to or separate from each other to position the sheet P placed on the base surface 110S. A pair of cursors 112 and 113 can move on the base surface 110S in the sheet width direction H2 between the first position and the second position with the sheet width direction center S1 used as the reference position. The cursors 112 and 113 are separated by the maximum distance when disposed at the first position and by the minimum distance when disposed at the second position. A pair of cursors 112 and 113 positioned at the first position is indicated by broken lines in FIGS. 2 and 3. A pair of cursors 112 and 113 positioned at the second position is indicated by solid lines in FIGS. 2 and 3.

Hereinafter, among a pair of cursors 112 and 113, the cursor disposed in one side in the sheet width direction H2 (+Y side, or forward side) is referred to as "first cursor 112", and the other cursor disposed in the other side in the sheet width direction H2 (−Y side, or rearward side) is referred to as "second cursor 113".

As illustrated in FIG. 4, the first cursor 112 includes a reference position determinator 1121, a first base part 1122, and a sub-cursor 114.

The reference position determinator 1121 is a plate member extending parallel to the feeding direction H1 and protruding upward from the top face of the lifting plate 1101 (base surface 110S). The reference position determinator 1121 determines the reference position (second reference position) used as a reference for the sub-cursor 114 moving toward the second cursor 113. The first base part 1122 is a plate member horizontally extending to protrude in −Y side from the bottom end of the reference position determinator 1121. The reference position determinator 1121 and the first base part 1122 can move in an integrated manner in the sheet width direction H2.

Figure 5:
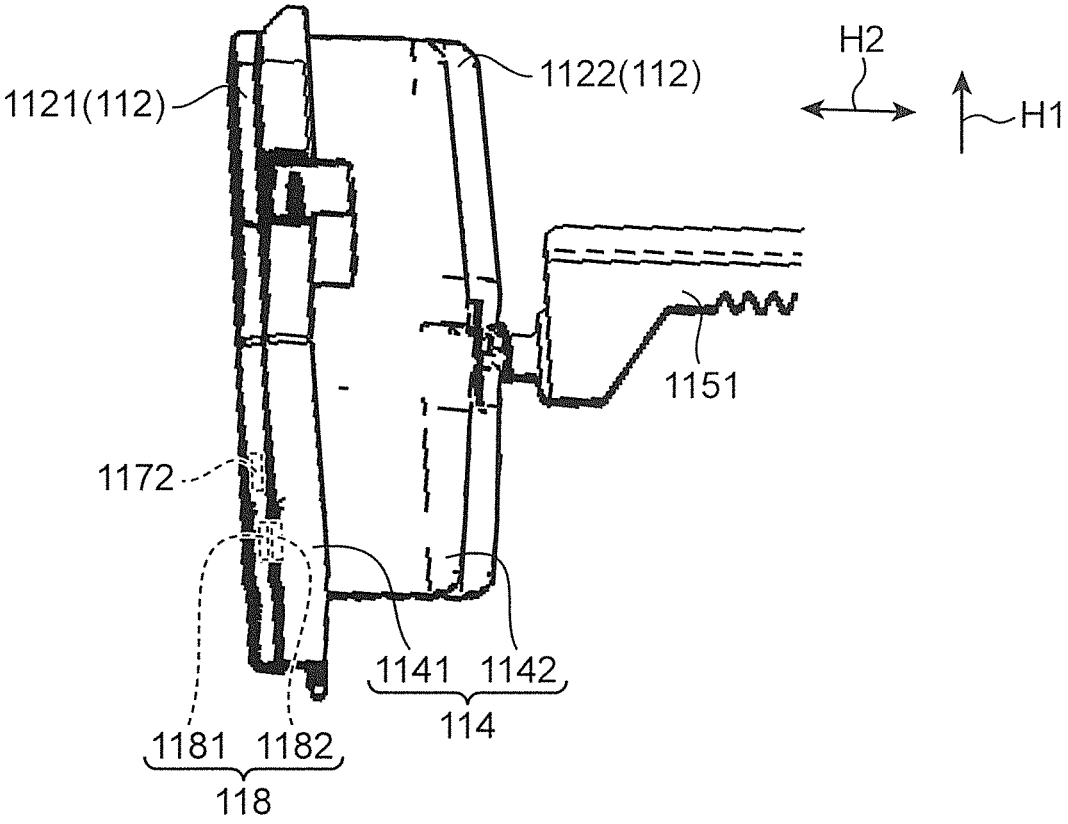
FIG. 5 is a perspective view of a first cursor that includes a sub-cursor and is provided in the sheet feeding device.
Figure 6:
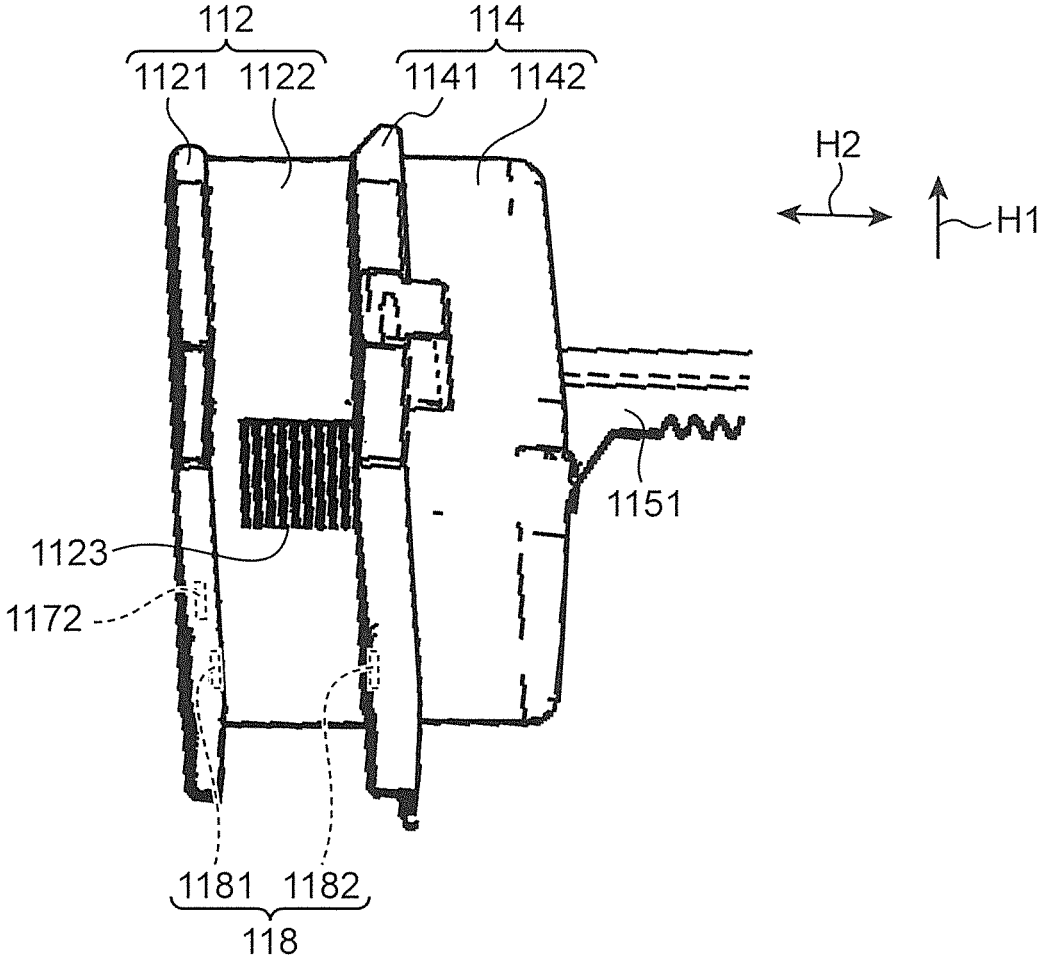
FIG. 6 is a perspective view illustrating the sub-cursor that has moved relative to the first cursor.

The sub-cursor 114 is disposed on the first base part 1122 in a manner movable in the sheet width direction H2. The sub-cursor 114 will now be described with reference to FIGS. 5 and 6 in addition to FIG. 4. FIG. 5 is a perspective view of the first cursor 112 that includes a sub-cursor 114 and is provided in the sheet feeding device 100. FIG. 6 is a perspective view illustrating the sub-cursor 114 that has moved from the first cursor 112. The sub-cursor 114 is a portion for positioning the sheet in the first cursor 112 when the sub-cursor 114 is arranged at the second reference position.

The sub-cursor 114 includes a sub-cursor body 1141 and a base part 1142. The sub-cursor body 1141 is a plate member extending parallel to the feeding direction H1 and protruding upward from the first base part 1122. The base part 1142 is a plate member horizontally extending to protrude in −Y side from the bottom end of the sub-cursor body 1141. With the first cursor 112 and the second cursor 113 disposed at the second position, the sub-cursor 114 can move on the first base part 1122 from the reference position where the sub-cursor body 1141 is in contact with or in the proximity of the reference position determinator 1121 (as illustrated in FIG. 5) toward the second cursor 113.

As illustrated in FIG. 6, the first base part 1122 of the first cursor 112 is provided with a stopper rack 1123 extending along the sheet width direction H2. The stopper rack 1123 is for fixing the sub-cursor 114 on the first base part 1122.

As illustrated in FIG. 4, the second cursor 113 includes a second cursor body 1131 and a second base part 1132. The second cursor body 1131 is a plate member extending parallel to the feeding direction H1 and protruding upward from the top face of the lifting plate 1101 (base surface 110S). The second cursor body 1131 opposes the reference position determinator 1121 and the sub-cursor body 1141 in the sheet width direction H2 with the feeding roller 111 therebetween. The second base part 1132 is a plate member horizontally extending to protrude in +Y side from the bottom end of the second cursor body 1131. The second cursor body 1131 and the second base part 1132 can move in an integrated manner in the sheet width direction H2.

With the sheet feeding device 100 configured as described above, the sheets P of various sizes can be positioned and fed. The sheet P includes the normal width sheet P1 of a normal size having a width equal to or larger than the distance between the first cursor 112 and the second cursor 113 at the second position and the narrow sheet P2 of a special size having a width smaller than the distance between the first cursor 112 and the second cursor 113 disposed at the second position. That is, if the normal width sheet P1 of a normal size is placed on the base surface 110S of the manual feed tray 110, a pair of the first cursor 112 and the second cursor 113 are moved with the sheet width direction center S1 on the base surface 110S used as the reference position to make contact with both side faces of the normal width sheet P1. The normal width sheet P1 can thus be positioned.

If the narrow sheet P2 of a special size is placed on the base surface 110S along the second cursor 113, the narrow sheet P2 is positioned as follows. With a pair of the first cursor 112 and the second cursor 113 disposed at the second position, the sub-cursor 114 is moved from the reference position toward the second cursor 113. The reference position is where the sub-cursor body 1141 is in contact with or in the proximity of the reference position determinator 1121. With the narrow sheet P2 placed with one side face (side face in −Y side) along the second cursor 113, the sub-cursor 114 comes in contact with the other side face (side face in +Y side) of the second narrow sheet P2. The narrow sheet P2 can thus be positioned. Accordingly, the sheets P of various sizes can be positioned by the first cursor 112, the second cursor 113, and the sub-cursor 114. A sheet feeding device 100 having excellent property of feeding a sheet can thus be provided.

As illustrated in FIG. 4, the sheet feeding device 100 further includes a cursor moving mechanism 115 and a sheet detector 116.

The sheet detector 116 is disposed on the top face of the lifting plate 1101 (base surface 110S) to be separated from the feeding roller 111 toward the second cursor 113 in the sheet width direction H2 (in −Y side, or rear side). When a pair of the first cursor 112 and the second cursor 113 is disposed at the second position, the sheet detector 116 exists between a pair of the first cursor 112 and the second cursor 113. The sheet detector 116 is a sensor that detects the sheet P placed on the base surface 110S of the manual feed tray 110.

The cursor moving mechanism 115 is a mechanism for moving a pair of first cursor 112 and the second cursor 113 in conjunction with each other to come close to or separate from each other along the sheet width direction H2. The cursor moving mechanism 115 includes a first rack bar 1151, a second rack bar 1152 and a pinion gear 1153. The first rack bar 1151 extends from the first base part 1122 of the first cursor 112 in −Y side along the sheet width direction H2. The second rack bar 1152 extends from the second base part 1132 of the second cursor 113 in +Y side along the sheet width direction H2.

The pinion gear 1153 is rotatably supported on a shaft protruding from the top face of the lifting plate 1101 (base surface 110S) and between the first cursor 112 and the second cursor 113. The pinion gear 1153 meshes with the first rack bar 1151 and the second rack bar 1152. In this manner, each of the first cursor 112 and the second cursor 113 moves along the sheet width direction H2 in conjunction with the rotation of the pinion gear 1153. That is, the first cursor 112 moves in the sheet width direction H2 in conjunction with the first rack bar 1151 moving in the sheet width direction H2 by the rotation of the pinion gear 1153. In conjunction with the second rack bar 1152 moving in the sheet width direction H2 by the rotation of the pinion gear 1153, the second cursor 113 moves in the direction opposite the moving direction of the first cursor 112.

From the state in which the first cursor 112 and the second cursor 113, which move in conjunction with each other via the cursor moving mechanism 115, are disposed at the first position where the first cursor 112 and the second cursor 113 are separated by the maximum distance (illustrated in broken lines in FIGS. 2 and 3), a first separate distance L1 between the first cursor 112 and the second cursor 113 in the sheet width direction H2 (see FIG. 3) is suitably set according to the maximum width of the normal width sheet P1 that is placed on the manual feed tray 110. To explain the first separate distance L1 in more detail, the distance between the sub-cursor body 1141 which is in contact with or in the proximity of the reference position determinator 1121 and the second cursor body 1131 in a state where the first cursor 112 and the second cursor 113 are disposed at the first position is the first separate distance L1.

With the first cursor 112 and the second cursor 113 disposed at the second position where the first cursor 112 and the second cursor 113 are separated by the minimum distance (as illustrated in solid lines in FIGS. 2 and 3), a second separate distance L2 between the first cursor 112 and the second cursor 113 in the sheet width direction H2 (see FIGS. 3 and 4) is suitably set according to the minimum width of the normal width sheet P1 that is placed on the manual feed tray 110. To explain the second separate distance L2 in more detail, the distance between the sub-cursor body 1141 in contact with or in the proximity of the reference position determinator 1121 and the second cursor body 1131 in a state where the first cursor 112 and the second cursor 113 are disposed at the second position is the second separate distance L2.

With the first cursor 112 and the second cursor 113 disposed at the second position, the second cursor 113 is positioned so as the second cursor body 1131 to be in the outer side (−Y side), along the sheet width direction H2, of the sheet detector 116 (see FIG. 4).

With the first cursor 112 and the second cursor 113 disposed at the second position, the sub-cursor 114 can move from the reference position where the sub-cursor body 1141 is in contact with or in the proximity of the reference position determinator 1121 to be separated from the reference position determinator 1121 into the outer side of one side face (the +Y side face) of the feeding roller 111.

FIG. 4 illustrates the sub-cursor 114 that has moved toward the second cursor 113 so as the sub-cursor body 1141 to be separated from the reference position determinator 1121 by the maximum distance. In the state illustrated in FIG. 4, a third separate distance L3 between the sub-cursor body 1141 and the second cursor body 1131 in the sheet width direction H2 is the minimum width of the narrow sheet P2 (for example, about 60 mm).

As described above, the sheet detector 116 is disposed on the base surface 110S of the manual feed tray 110 to be in a side closer to the second cursor 113 (−Y side) of the feeding roller 111 provided in the center along the sheet width direction. The sheet detector 116 is disposed in such a place because a separation member, such as a separation pad, is disposed just below the feeding roller 111 and thus the sheet detector 116 cannot be disposed in the center, along the sheet width direction, of the base surface 110S.

The sheet P is positioned by a pair of the first cursor 112 and the second cursor 113 with the sheet width direction center S1 on the base surface 110S used as the reference position. If the narrow sheet P2 of a special size is positioned by a pair of the first cursor 112 and the second cursor 113, the sheet detector 116 cannot detect the narrow sheet P2 because the second cursor 113 is positioned in the inner side, along the sheet width direction H2, of the sheet detector 116.

Thus, the sub-cursor 114 is used to position the narrow sheet P2 of a special size. If the narrow sheet P2 is placed along the second cursor 113 on the base surface 110S, the sub-cursor 114 in the outer side of one side face of the feeding roller 111 is moved from the reference position toward the second cursor 113 with a pair of the first cursor 112 and the second cursor 113 disposed at the second position. The sub-cursor 114 then comes in contact with one side face (the +Y side face) of the narrow sheet P2 to position the narrow sheet P2.

With a pair of the first cursor 112 and the second cursor 113 disposed at the second position, the second cursor 113 is positioned in the outer side along the sheet width direction H2 of the sheet detector 116. As described above, positioning of the narrow sheet P2 of a special size is performed by moving the sub-cursor 114 toward the second cursor 113 using the second cursor 113 positioned at the second position in the outer side of the sheet detector 116 as the reference. With the narrow sheet P2 of a special size positioned by the sub-cursor 114 and the second cursor 113, the sheet detector 116 can detect the narrow sheet P2 because the second cursor 113 is positioned in the outer side, along the sheet width direction H2, of the sheet detector 116.

As illustrated in FIGS. 4 to 6, the sheet feeding device 100 further includes a first cursor movement detector 117 and the second cursor movement detector 118.

The first cursor movement detector 117 detects the first cursor 112 moving relative to the top face (base surface 110S) of the lifting plate 1101. Since the first cursor 112 and the second cursor 113 move in conjunction with each other by the cursor moving mechanism 115, the first cursor movement detector 117 that detects the movement of the first cursor 112 also detects the movement of the second cursor 113.

In the embodiment, the first cursor movement detector 117 is a variable resistor including a resistance body 1171 and a moving contact 1172. The resistance body 1171 is provided on the top face of the lifting plate 1101 (base surface 110S) to linearly extend in the sheet width direction H2. The moving contact 1172 is embedded in the reference position determinator 1121 so as a portion of the moving contact 1172 to be exposed from the −Z face (the face opposing the lifting plate 1101) of the reference position determinator 1121. With the first cursor movement detector 117 thus configured, the cursor moving mechanism 115 causes the moving contact 1172 to move on the resistance body 1171 along with the movement of the first cursor 112 in the sheet width direction H2. The resistances between the ends of the resistance body 1171 and the moving contact 1172 change by the movement of the moving contact 1172 on the resistance body 1171.

The first cursor movement detector 117 outputs the change in resistance as a detection signal to a controller 200

(see FIG. 8) which will be described later. The detection signal that is output by the first cursor movement detector 117 configured with a variable resistor is used for detecting the movement of the first cursor 112 (and the second cursor 113) and also for identifying the position, along the sheet width direction H2, of the first cursor 112 (and the second cursor 113) on the top face of the lifting plate 1101 (base surface 110S).

The second cursor movement detector 118 detects the movement of the sub-cursor 114 on the first base part 1122. The second cursor movement detector 118 includes a first cursor contact 1181 and a sub-cursor contact 1182. The first cursor contact 1181 is embedded in the reference position determinator 1121 so as a portion of the first cursor contact 1181 to be exposed from the −Y face (the face opposing the sub-cursor body 1141) of the reference position determinator 1121. The sub-cursor contact 1182 is embedded in the sub-cursor body 1141 so as a portion of the sub-cursor contact 1182 to be exposed from the +Y face (the face opposing the reference position determinator 1121) of the sub-cursor body 1141.

With the second cursor movement detector 118 thus configured, the first cursor contact 1181 is in contact with the sub-cursor contact 1182 when the sub-cursor body 1141 is in contact with or in the proximity of the reference position determinator 1121. With the first cursor 112 and the second cursor 113 disposed at the second position, when the sub-cursor 114 moves toward the second cursor 113 so as the sub-cursor body 1141 to be separated from the reference position determinator 1121, the first cursor contact 1181 is separated from the sub-cursor contact 1182. The movement of the sub-cursor 114 on the first base part 1122 can thus be detected. The second cursor movement detector 118 outputs the detection signal to the controller 200 which will be described later. The detection signal that is output from the second cursor movement detector 118 is used to detect the movement of the sub-cursor 114.

Figure 7:
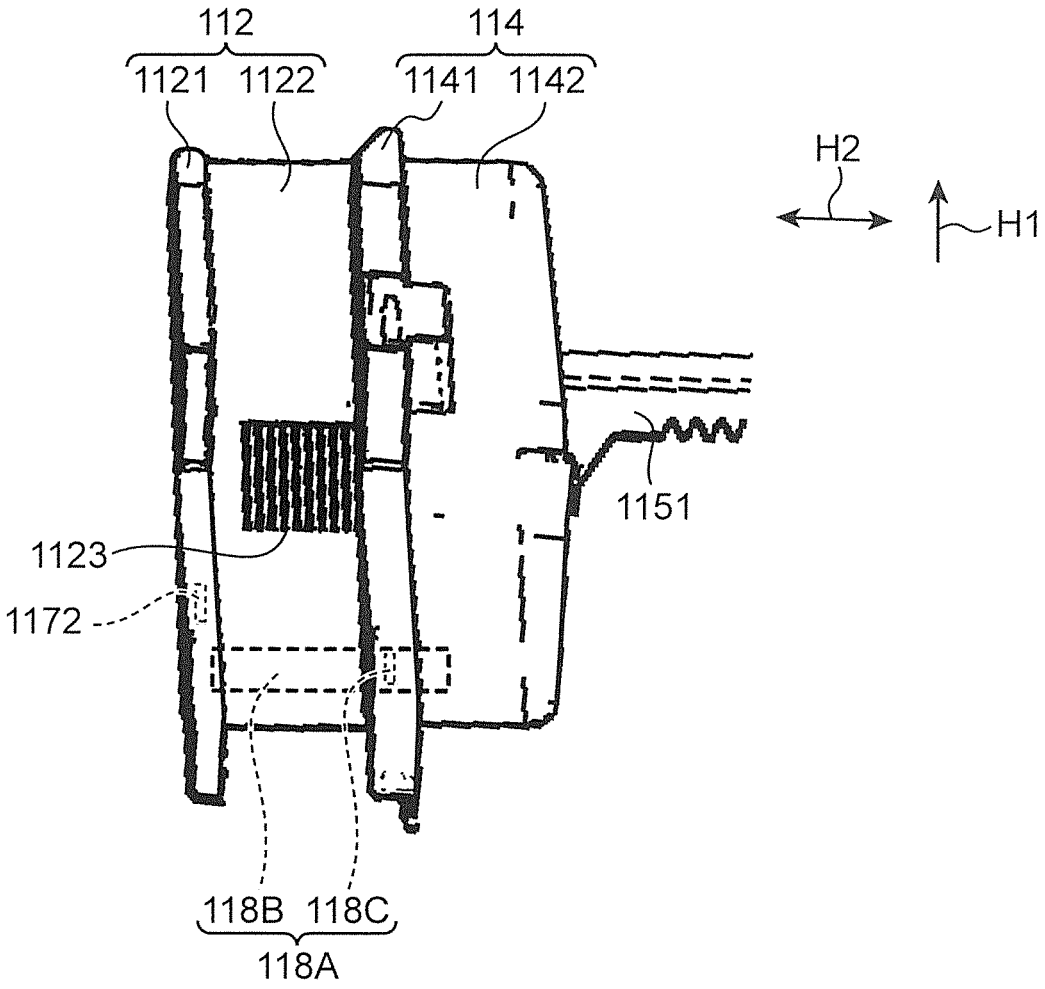
FIG. 7 is a perspective view illustrating an exemplary modification of a second cursor movement detector that detects the movement of the sub-cursor.

The second cursor movement detector 118 not necessarily includes the first cursor contact 1181 and the sub-cursor contact 1182 as illustrated in FIGS. 4 to 6 but may be configured as illustrated in FIG. 7. FIG. 7 is a perspective view illustrating an exemplary modification of the second cursor movement detector that detects the movement of the sub-cursor 114. A second cursor movement detector 118A illustrated in FIG. 7 is a variable resistor including a resistance body 118B and a moving contact 118C. The resistance body 118B is provided on the top face of the first base part 1122 of the first cursor 112 to linearly extend in the sheet width direction H2. The moving contact 118C is embedded in the sub-cursor body 1141 so as a portion of the moving contact 118C to be exposed from the −Z face (the face opposing the first base part 1122) of the sub-cursor body 1141. With the second cursor movement detector 118A thus configured, the moving contact 118C moves, in the sheet width direction H2, on the resistance body 118B along with the movement of the sub-cursor 114 on the first base part 1122. The resistances between the ends of the resistance body 118B and the moving contact 118C change by the movement of the moving contact 118C along the resistance body 118B.

The second cursor movement detector 118A outputs the change in resistance as a detection signal to the controller 200 which will be described later. The detection signal that is output from the second cursor movement detector 118A configured with the variable resistor is used for detecting the movement of the sub-cursor 114 on the first base part 1122 and also for identifying the distance by which the sub-cursor 114 has moved from the reference position.

[Electrical Configuration of Image Forming Apparatus]

Figure 8:
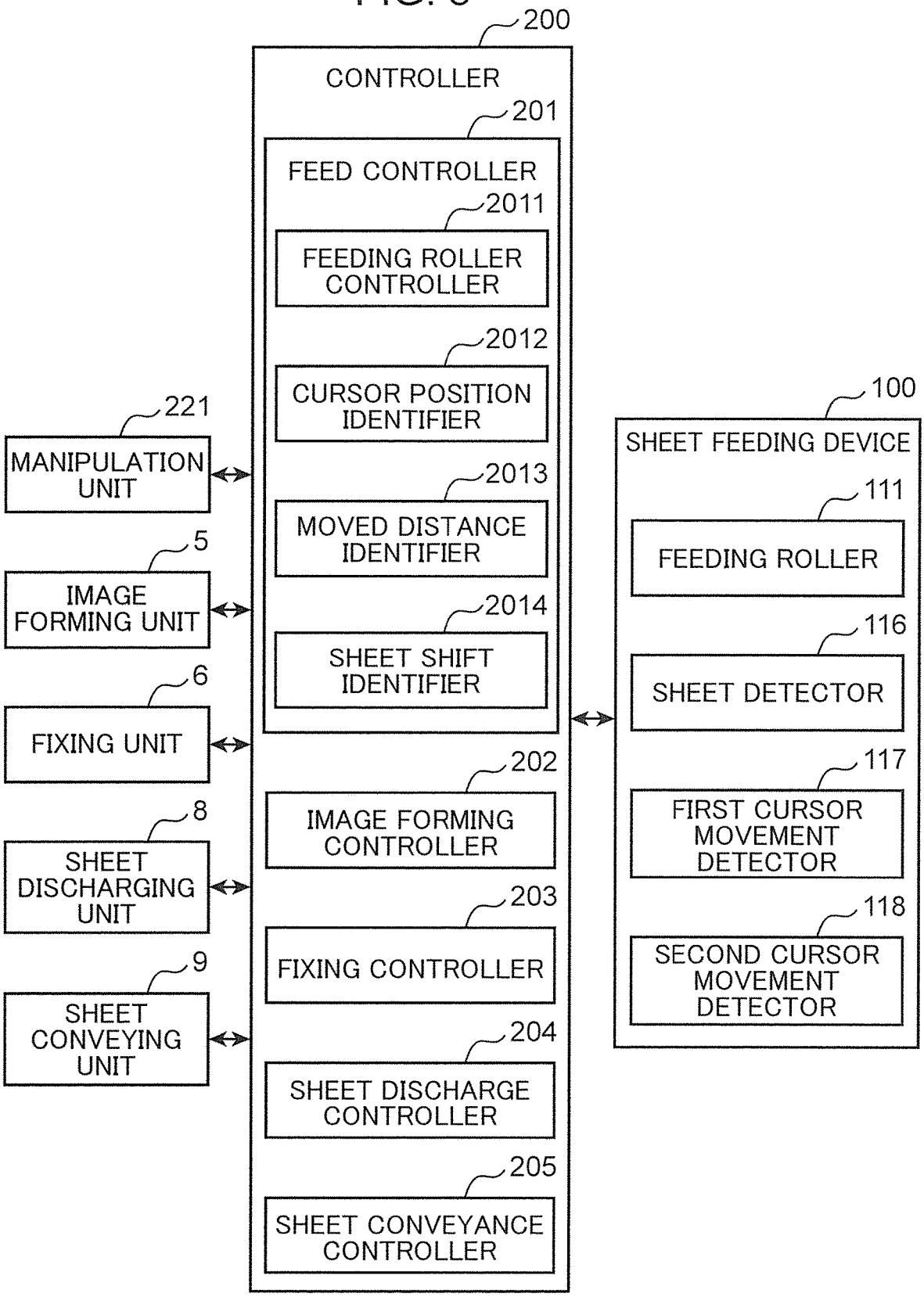
FIG. 8 is a block diagram illustrating an electrical configuration of the image forming apparatus.

The electrical configuration of the image forming apparatus 1 including the sheet feeding device 100 will now be described with reference to FIG. 8. FIG. 8 is a block diagram illustrating an electrical configuration of the image forming apparatus 1. The image forming apparatus 1 includes a controller 200 that totally controls the operations of the components constituting the image forming apparatus 1.

The controller 200 includes a central processing unit (CPU), a read only memory (ROM) that stores a control program, and a random access memory (RAM) that is used as a work space for the CPU. The controller 200 controls the components of the image forming apparatus 1 by the CPU executing a control program stored in the ROM.

The controller 200 includes a feed controller 201 that controls the sheet feeding device 100, an image forming controller 202 that controls the image forming unit 5, a fixing controller 203 that controls the fixing unit 6, a sheet discharge controller 204 that controls the sheet discharging unit 8, and a sheet conveyance controller 205 that controls the sheet conveying unit 9.

The feed controller 201 constitutes a part of the sheet feeding device 100. The feed controller 201 includes a feeding roller controller 2011, a cursor position identifier 2012, a moved distance identifier 2013, and a sheet shift identifier 2014.

When the sheet detector 116 detects the sheet P being placed on the base surface 110S of the manual feed tray 110, the feeding roller controller 2011 controls the driving of the feeding roller 111 based on the detection.

Based on the detection signal related to the movement of the first cursor 112 (and the second cursor 113) given by the first cursor movement detector 117, the cursor position identifier 2012 identifies the position, along the sheet width direction H2, on the base surface 110S of the reference position determinator 1121 (and the second cursor body 1131). Specifically, the cursor position identifier 2012 identifies the position of the reference position determinator 1121 (and the second cursor body 1131) based on the detection signal related to the change in the resistance corresponding to the movement of the moving contact 1172 on the resistance body 1171 of the first cursor movement detector 117 configured with a variable resistor.

Based on the detection signal related to the movement of the sub-cursor 114 given by the second cursor movement detector 118 or the second cursor movement detector 118A, the moved distance identifier 2013 identifies the distance by which the sub-cursor 114 has moved toward the second cursor 113 from the reference position in a state where a pair of the first cursor 112 and the second cursor 113 is disposed at the second position. In a case where the detector that detects the movement of the sub-cursor 114 is the second cursor movement detector 118 including the first cursor contact 1181 and the sub-cursor contact 1182 as illustrated in FIGS. 4 to 6, the moved distance identifier 2013 identifies the distance by which the sub-cursor 114 has moved toward the second cursor 113 from the reference position based on detection of separation of the sub-cursor contact 1182 from the first cursor contact 1181 and the information related to the size of the narrow sheet P2 of a special size that is input to the manipulation unit 221.

In a case where the detector that detects the movement of the sub-cursor 114 is the second cursor movement detector 118A configured with the variable resistor as illustrated in FIG. 7, the moved distance identifier 2013 identifies the distance by which the sub-cursor 114 has moved toward the second cursor 113 from the reference position based on the detection signal related to the change in the resistance corresponding to the movement of the moving contact 118C on the resistance body 118B. In this case, the moved distance identifier 2013 can identify the distance by which the sub-cursor 114 has moved toward the second cursor 113 from the reference position based only on the detection signal that is related to the change in the resistance and given by the second cursor movement detector 118A without using the information that is related to the size of the narrow sheet P2 of a special size and given through the manipulation unit 221.

Based on the moved distance of the sub-cursor 114 identified by the moved distance identifier 2013, the sheet shift identifier 2014 identifies the shift amount of the center, along the sheet width direction H2, of the narrow sheet P2 of a special size from the sheet width direction center 51 on the base surface 110S. Specifically, the sheet shift identifier 2014 performs computational processing of multiplying by ½ the moved distance of the sub-cursor 114 identified by the moved distance identifier 2013 to thereby identify the shift amount of the center of the narrow sheet P2 in the sheet width direction H2 from the sheet width direction center S1 on the base surface 110S.

As described above, the normal width sheet P1 of a normal size is positioned by a pair of the first cursor 112 and the second cursor 113 with the sheet width direction center S1 on the base surface 110S used as the reference position. The narrow sheet P2 of a special size is positioned using the sub-cursor 114 and the second cursor 113 by moving the sub-cursor 114 toward the second cursor 113 with the second cursor 113 positioned at the second position used as the reference. Thus, the center of the narrow sheet P2 of a special size that is positioned by the sub-cursor 114 and the second cursor 113 and fed by the feeding roller 111 shifts, along the sheet width direction H2, from the center S1 on the base surface 110S toward the second cursor 113. Thus, an image printed on such a narrow sheet P2 shifts.

The sheet feeding device 100 includes the moved distance identifier 2013 and the sheet shift identifier 2014. The moved distance identifier 2013 identifies the distance by which the sub-cursor 114 has moved from the reference position in a state where a pair of the first cursor 112 and the second cursor 113 are disposed at the second position. Based on the identified result, the sheet shift identifier 2014 identifies the shift amount of the center of the narrow sheet P2 from the sheet width direction center S1 on the base surface 110S. When forming an image on the narrow sheet P2 that is positioned by the sub-cursor 114 and the second cursor 113 and fed by the feeding roller 111, the image forming controller 202 controls the image forming unit 5 to correct the start position of printing the image with reference to the result identified by the sheet shift identifier 2014. In this manner, a shift of an image formed on the narrow sheet P2 can be prevented.

Furthermore, the image forming apparatus 1 according to the embodiment includes the sheet feeding device 100 that has excellent properties of feeding the sheets P of various sizes. The sheets P of various sizes can be fed toward the image forming unit 5 to form an image by the image forming unit 5.

The disclosure is not limited to the embodiment described above and various exemplary modifications can be made. Although the embodiment is described for the sheet feeding device 100 that feeds the sheet P placed on the manual feed tray 110, the embodiment is not limited to such a configuration. For example, the sheet feeding device according to the disclosure may be applied to the sheet feeder 4 that feeds the sheet P stored in the tray 31.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeding device comprising:

a sheet stacking base that has a base surface on which a sheet is placed;

a feeding member that is provided at a center, in a sheet width direction, of the base surface, and feeds the sheet placed on the base surface in a feeding direction perpendicular to the sheet width direction; and a pair of cursors including a first cursor and a second cursor for positioning the sheet placed on the base surface, the first cursor and the second cursor coming close to and separating from each other in the sheet width direction on the base surface with the center, in the sheet width direction, of the base surface used as a first reference position, wherein the first cursor and the second cursor are movable between a first position where the first cursor and the second cursor are separated by a maximum distance and a second position where the first cursor and the second cursor are separated by a minimum distance, the first cursor of the pair of cursors includes a base part that is movable in the sheet width direction on the base surface, and a sub-cursor is provided on the first cursor and is movable linearly on the base part in the sheet width direction and relative to the first cursor from a second reference position on the first cursor toward the second cursor, the sub-cursor that is at the second reference position being a portion for positioning the sheet in the first cursor, and in a case where the sheet that is placed on the base surface is a narrow sheet that has a width smaller than a distance between the first cursor and the second cursor when the sub-cursor is at the second reference position and the second cursor is at the second position, then the sub-cursor is moved relative to the first cursor from the second reference position toward the second cursor to be brought into contact with a side face of the narrow sheet so as to position the narrow sheet.

2. The sheet feeding device according to claim 1, further comprising a sheet detector that is disposed on the base surface to detect the sheet placed on the base surface, the sheet detector being separated from the feeding member in the sheet width direction toward the second cursor, wherein the sheet detector at the second position is provided between the first cursor and the second cursor.

3. The sheet feeding device according to claim 2, further comprising a cursor moving mechanism that moves the first cursor and the second cursor in conjunction with each other to separate from and come close to each other along the sheet width direction, wherein the cursor moving mechanism includes a pinion gear rotatably supported on a shaft protrudingly provided on the sheet stacking base, a first rack bar connected to the first cursor, and a second rack bar connected to the second cursor, the rack bars meshing with the pinion gear to move, the second cursor at the second position is in an outer side, in the sheet width direction, of the sheet detector, and the sub-cursor at the second position is movable from the second reference position to an outer side of a side face of the feeding member in the sheet width direction.

4. The sheet feeding device according to claim 3, further comprising:

a moved distance identifier that identifies a distance by which the sub-cursor is moved from the second reference position; and a sheet shift identifier that identifies, based on identification by the moved distance identifier, a shift of a center, in the sheet width direction, of the narrow sheet from the center, in the sheet width direction, of the base surface.

5. An image forming apparatus comprising:

a main body;

an image forming unit disposed in the main body to form an image on a sheet; and the sheet feeding device according to claim 1 mounted in the main body to feed the sheet to the image forming unit.

6. The sheet feeding device according to claim 1, wherein the first cursor further includes a reference position determinator protruding up from the base part, the second reference position is a position where the sub-cursor is in contact with or in the proximity of the reference position determinator.

* * * * *